United States Patent [19]

Gardner

[11] 4,030,659

[45] June 21, 1977

[54] PARTITION ARRANGEMENT

[75] Inventor: Jeffrey M. Gardner, Wheaton, Ill.

[73] Assignee: Container Corporation of America, Chicago, Ill.

[22] Filed: June 28, 1976

[21] Appl. No.: 700,389

[52] U.S. Cl. ..... 229/42; 229/15; 229/28 R

[51] Int. Cl.[2] ..... B65D 5/48

[58] Field of Search ..... 229/15, 28, 42

[56] References Cited

UNITED STATES PATENTS

| | | | |
|---|---|---|---|
| 2,596,205 | 5/1976 | Buttery | 229/28 R |
| 2,958,452 | 11/1960 | Kuchenbecker | 229/15 |
| 3,738,561 | 6/1973 | Nederveld | 229/15 |
| 3,834,608 | 9/1974 | Giebel | 229/28 R X |
| 3,921,891 | 11/1975 | Gorham | 229/15 |
| 3,931,924 | 1/1976 | Gardner et al. | 229/42 |
| 3,963,169 | 6/1976 | Gardner | 229/28 R |
| 3,985,286 | 10/1976 | Hicks | 229/15 |

*Primary Examiner*—Davis T. Moorhead
*Attorney, Agent, or Firm*—Carpenter & Ostis

[57] ABSTRACT

A shipping container partition arrangement which is formed of a unitary blank of foldable paperboard and which includes a pair of interlocking center members disposed at right angles with respect to each other, a pair of end members disposed in parallel relation with one of said center members, and a bottom wall foldably connected to the end members and one of the center members.

2 Claims, 5 Drawing Figures

PARTITION ARRANGEMENT

SUMMARY OF THE INVENTION

The invention relates to partitions of the type used in paperboard shipping containers.

It is an object of the invention to provide an improved, heavy-duty partition formed of a unitary blank of foldable sheet material, such as corrugated paperboard or the like, which is suitable for use either as an internal partition in an outer shipping container or as a basic package for use with a plastic film overwrap.

A more specific object of the invention is to provide a partition, of the type described, which includes a pair of vertical center members disposed at right angles to each other in interlocking relation, a pair of vertical end members disposed in parallel relation to one of the center members, and a horizontal bottom wall foldably connected to the end members and one of the center members.

These and other objects of the invention will be apparent from an examination of the following description and drawing.

THE DRAWINGS

It will be understood that, for purposes of clarity, certain elements may have been intentionally omitted from certain views where they are believed to be illustrated to better advantage in other views.

THE DESCRIPTION

Figure 3:
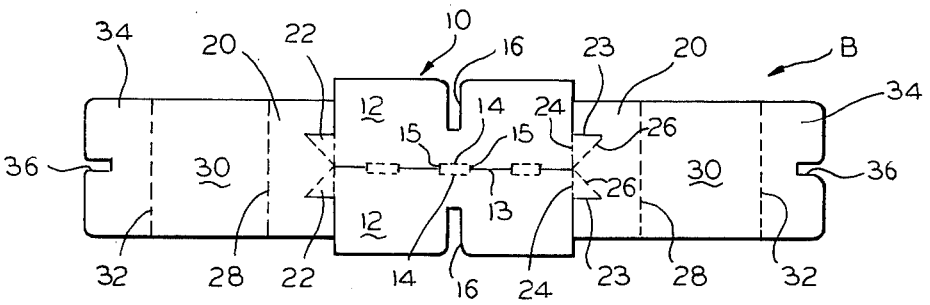
FIG. 3 is a plan view of a blank of paperboard from which the partition of the previous views may be formed.
Figure 1:
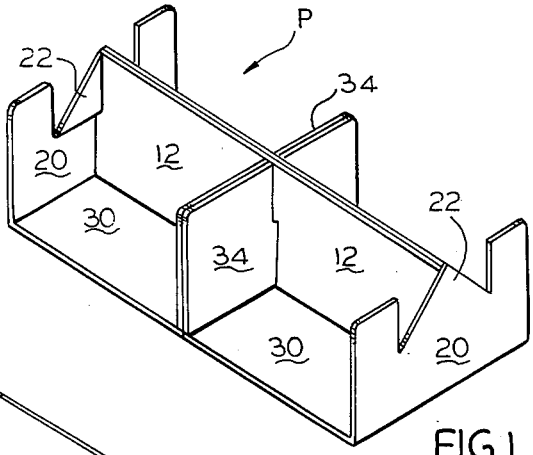
FIG. 1 is a perspective view of an erected partition embodying features of the invention.

Referring now to the drawings for a better understanding of the invention, it will be seen that there is illustrated in FIG. 1, a fully erected partition indicated generally at P which may be formed from the unitary blank B of foldable sheet material such as paperboard which is illustrated in FIG. 3 of the drawings.

The partition includes a first vertically disposed center member, indicated generally at 10, which compises a pair of similar panels 12 disposed in face-to-face relation to form a double-ply structure.

Panels 12 are separated in certain areas from each other by a cut line 13 and are foldably joined to each other in other areas by hinges which are formed by a pair of closely separated parallel score lines 14 which in turn are separated from the cut lines 13 by short cut lines 15. This hinge score arrangement permits the panels to be folded easily so as to lie snugly in face-to-face relation, when the partition is in the assembled or erected condition. Along their free edges, panels 12 are provided with slots 16, the purpose of which is described later in the specification.

At each end of the center member 10, there is provided a vertically disposed end member 20, which is foldably connected to the adjacent ends of the first center member panels 12 by means of a pair of preferably triangular gusset elements 22. Gusset elements 22 are formed from material cut from end members 20 along cut lines 23 and are foldably connected to the ends of the center member panels 12 and to the end member 20 along diverging fold lines 24 and 26, respectively. Foldably joined to the opposite or lower edges of end members 20 along fold lines 28 are a pair of co-planar bottom wall panels 30 which form a bottom wall for the structure.

Foldably joined to the inboard edges of each bottom wall panels 30 along fold line 32 is a second center member panel 34 which is provided at its free edge with a notch 36.

Figure 2:
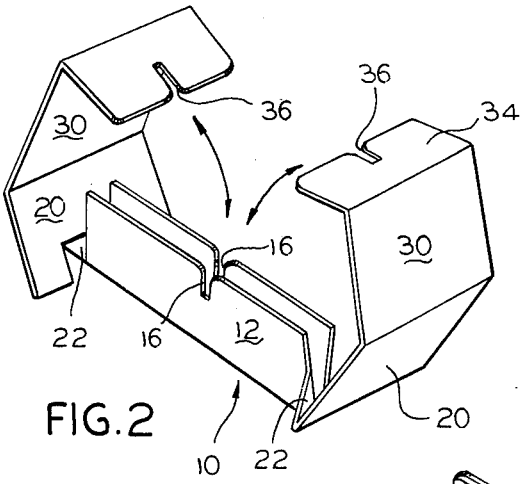
FIG. 2 is a perspective view of the structure illustrated in FIG. 1, but with the partition shown inverted and in a partially erected condition to illustrate the manner in which the partition is assembled.

As best seen in FIG. 2, in order to assemble the partition structure, the first center member panels 12 are each folded 90° toward each other so as to lie in face-to-face relation. End members 20 are then folded 90° toward each other so as to lie against the ends of first center member 10. Bottom wall panels 30 are then folded to lie against the lower edges of first center member panels 12, and, at the same time, second center member panels 34 are folded relative to bottom panels 30, so that when the partition is completely erected, the second center member panels 34 are disposed in face-to-face relation with the slots 36 of the second center member panels in interlocking engagement with the slots 16 of the first center member panels 12.

Thus, it will be seen that there is provided a rugged, heavy duty partition for a pair of double ply vertical center members disposed in interlocking engagement at right angles with each other, and which also includes a pair of end members and a bottom wall formed of a pair of co-planar panels. It will be understood that the novel partition may be used either as an internal partition within an outer shipping container, or as an integral package which after receiving the articles to be packaged may be overwrapped with a shrink plastic film or similar material.

Figure 5:
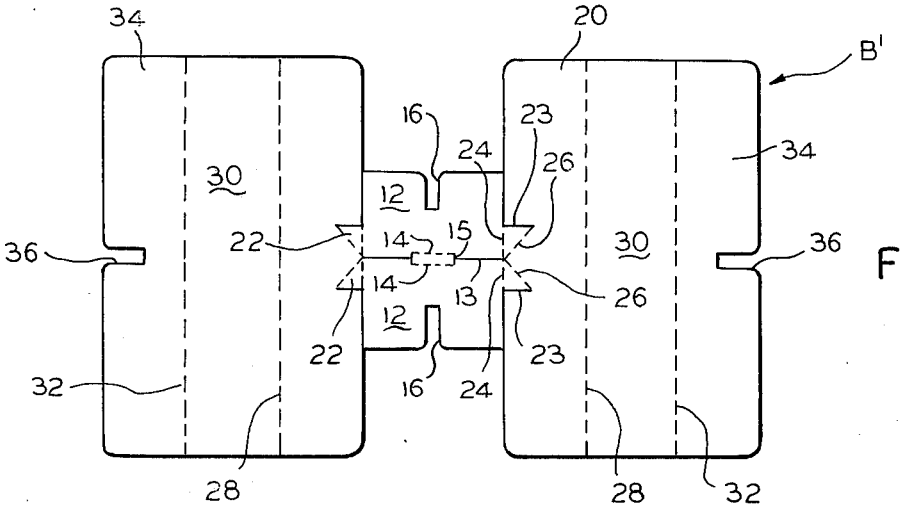
FIGS. 4 and 5 are views similar to those of FIGS. 1 and 3, respectively, but illustrating a slightly modified form of the invention.
Figure 4:
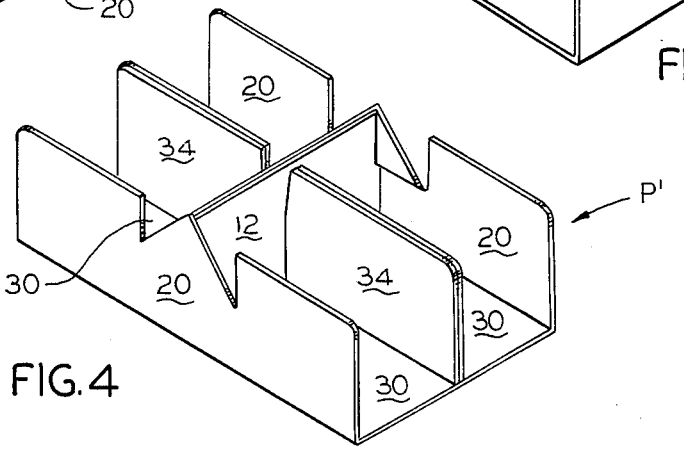

Referring now to FIGS. 4 and 5 of the drawings, it will be seen that the structures illustrated therein are similar to those of the previous views except for dimensions, and have been identified with numerals similar to those used for corresponding elements of the earlier views.

I claim:

1. In a heavy duty four cell partition arrangement formed from a unitary blank of sheet material such as paperboard or the like, the combination of:

a. a vertically disposed first double-ply center member including a pair of co-extensive panels hingedly interconnected at their upper edges and disposed in face to face relation;

b. a vertically disposed second double-ply center member extending normal to said first center member and including a pair of co-extensive panels disposed in face to face relation and presenting in their upper edges slots aligned with similar slots presented in the lower edges of the panels of said first center member to provide interlocking engagement between said first and second center members;

c. a pair of vertically disposed opposed end members which are parallel to the plane of said second center member, and which have portions foldably joined to end edges of said first center member by integral gusset elements;

d. a horizontally disposed bottom wall including a pair of co-planar bottom wall panels each being foldably connected at its opposite end edges to lower edges of one of said end member panels and to one of said second center member panels.

2. A partition arrangement according to claim 1, wherein said gusset elements are formed from material of said end members.

* * * * *